US007800008B2

(12) United States Patent
Shi et al.

(10) Patent No.: US 7,800,008 B2
(45) Date of Patent: Sep. 21, 2010

(54) SIDE KEY ASSEMBLY AND ELECTRONIC DEVICE USING THE SAME

(75) Inventors: Zheng Shi, Shenzhen (CN); Chih-Chiang Chang, Taipei Hsien (TW); Yao-Hao Chang, Taipei Hsien (TW)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 384 days.

(21) Appl. No.: 11/870,103

(22) Filed: Oct. 10, 2007

(65) Prior Publication Data

US 2008/0264768 A1 Oct. 30, 2008

(30) Foreign Application Priority Data

Apr. 25, 2007 (CN) ..... 2007 1 0074218

(51) Int. Cl.
*H01H 15/10* (2006.01)

(52) U.S. Cl. ..... 200/547; 200/550; 200/536

(58) Field of Classification Search ..... 200/296, 200/547, 549–551

See application file for complete search history.

(56) References Cited

U.S. PATENT DOCUMENTS

| | | | | |
|---|---|---|---|---|
| 7,208,692 | B2 * | 4/2007 | Yamaguchi | 200/547 |
| 7,269,439 | B2 * | 9/2007 | Honda | 455/550.1 |
| 2009/0223795 | A1 * | 9/2009 | Lee et al. | 200/329 |

* cited by examiner

*Primary Examiner*—Michael A Friedhofer
*Assistant Examiner*—Lheiren Mae A Caroc
(74) *Attorney, Agent, or Firm*—Jeffrey T. Knapp

(57) ABSTRACT

A side key assembly is mounted on a housing (60) which comprises a sidewall (610). A socket (62) is formed in the sidewall (610) of the housing. The side key assembly includes a button (70), two switches (80) and the socket. The button includes an operating portion (710), two touching blocks (740) and at least one elastic arm (750). The operating portion is slidingly received in the socket. One end of the at least one elastic arm connects with the operating portion while the other end is firmly fixed on the housing. Each switch includes a contact portion. Each contact portion is positioned adjacent to a corresponding touching block. Each switch is turned on when the corresponding touching block is moved to touch the contact portion thereof.

18 Claims, 7 Drawing Sheets

SIDE KEY ASSEMBLY AND ELECTRONIC DEVICE USING THE SAME

BACKGROUND OF THE INVENTION

1. Field of the Invention

The present invention relates to side key assemblies, particularly, to a side key assembly used in a portable electronic device and a portable electronic device using the same.

2. Description of Related Art

Many portable electronic devices have a housing with an inner compartment for receiving a printed circuit board therein, such as mobile phones, PDAs and so on. For convenience, a portable electronic device usually sets a side key assembly in a sidewall of the housing, so that the user can operate the electronic device by a single touch for receiving calls, activating background light, adjusting volume or browsing menu.

Referring to FIG. 7, a typical side key assembly is used in a portable electronic device 100. The portable electronic device 100 includes a housing 102 and a circuit board (not shown) mounted in the housing 102. Two receiving holes 104 are defined in a sidewall 106 of the housing 102. The side key assembly includes two buttons 102 and two switches (not shown). Each button 102 has an operating portion 108 and a contact portion (not shown). Each operating portion 108 is received in a corresponding one of the receiving holes 104 and one end thereof protrudes from the corresponding receiving hole 104 of the sidewall 106 of the housing 102. Thus, the operating portion 108 is externally accessible to a user. Each switch or a portion thereof is located on the circuit board. Each contact portion is positioned adjacent to a corresponding switch. When the user presses the operating portion 108, the corresponding contact portion actuates the switch so as to generate an electronic signal in response.

Since the operating portion 108 of each button 102 extends out from a corresponding receiving hole 104 of the sidewall 106 of the housing 102, the operating portion 108 of the button 102 is easily pushed/pressed by an unintentional operation. An accidental (warning) activation of the electronic device may result from this unintentional operation and cause inconvenience to the user.

Therefore, a new side key assembly is desired in order to overcome the above-described problems.

SUMMARY OF THE INVENTION

In one embodiment thereof, a side key assembly is mounted on a housing which comprises a sidewall defining a receiving hole. The side key assembly includes a button and two switches. The button includes an operating portion, two touching blocks and at least one elastic arm. The operating portion is slidingly received in the receiving hole. One end of the at least one elastic arm connects with the operating portion while the other end of the at least one elastic arm is firmly fixed on the housing. Each switch includes a contact portion positioned adjacent to a corresponding touching block. Each switch is turned on when the corresponding touching portion touches the contact portion thereof.

Other advantages and novel features will become more apparent from the following detailed description when taken in conjunction with the accompanying drawings.

BRIEF DESCRIPTION OF THE DRAWINGS

Many aspects of the side key assembly can be better understood with reference to the following drawings. The components in the drawings are not necessarily drawn to scale, the emphasis instead being placed upon clearly illustrating the principles of the present side key assembly. Moreover, in the drawings, like reference numerals designate corresponding parts throughout the several views.

DETAILED DESCRIPTION OF THE INVENTION

Figure 1:
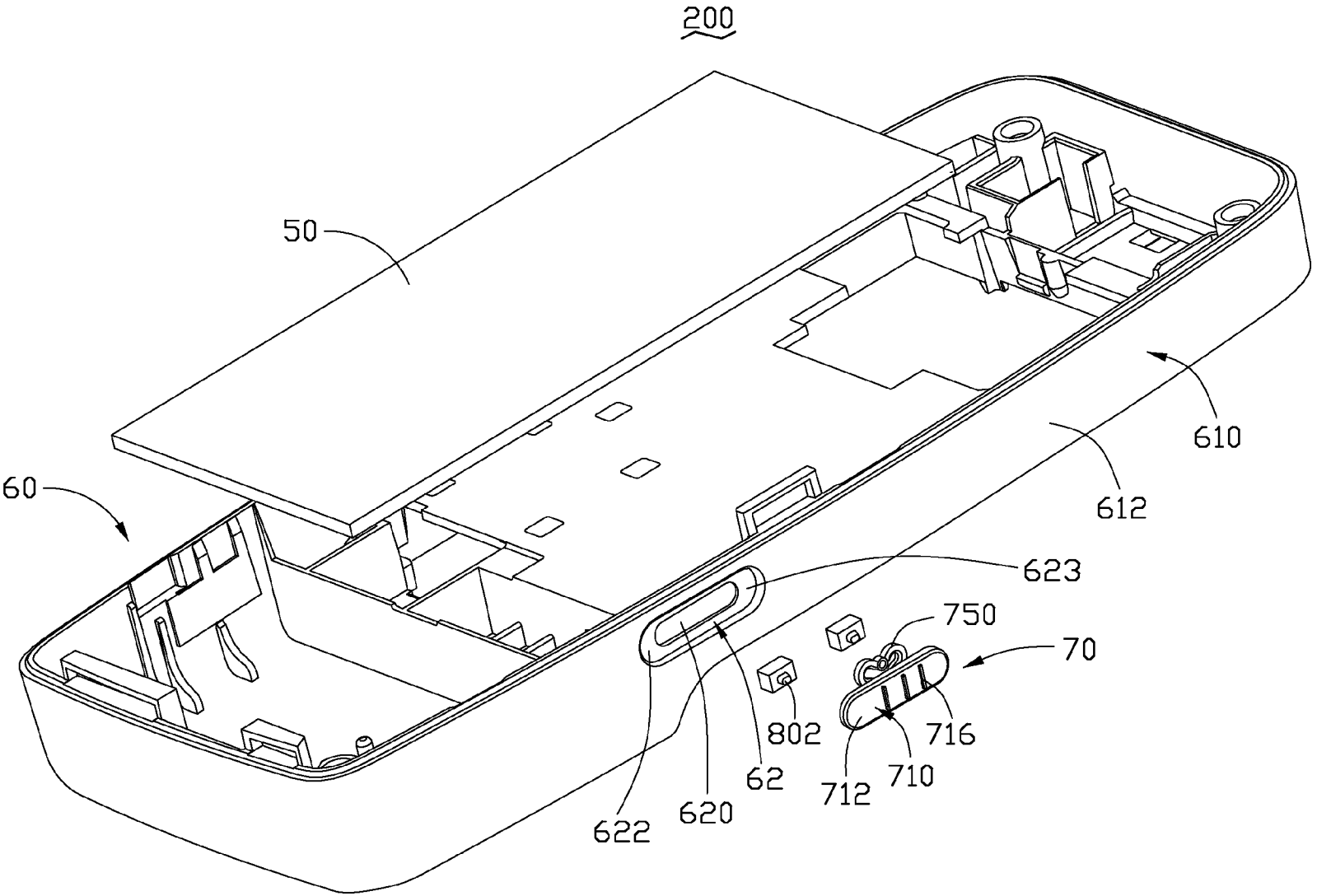
FIG. 1 is an isometric, exploded view of a portable electronic device, showing a printed circuit board, a housing and a side key assembly, in accordance with an embodiment of the present invention.

Referring now to FIG. 1, a side key assembly (not labeled) is applied to a portable electronic device 200. The portable electronic device 200 includes a printed circuit board 50 and a housing 60. The printed circuit board 50 is received in the housing 60.

Figure 2:
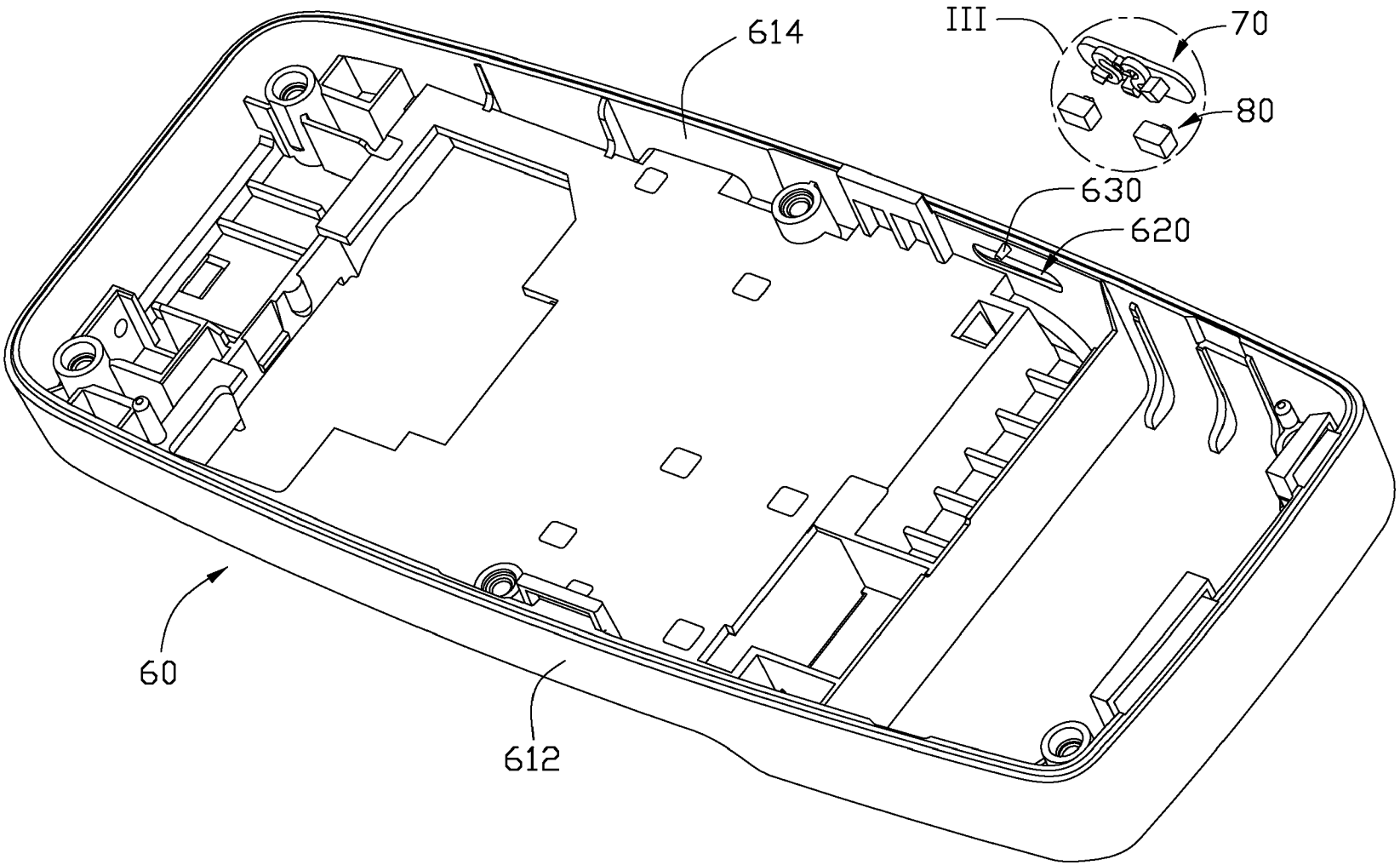
FIG. 2 is similar to FIG. 1, showing another aspect without the printed circuit board.

Also referring to FIG. 2, the housing 60 has a sidewall 610. The sidewall 610 includes an outer surface 612 and an inner surface 614 at an opposite side thereof. A socket 62 is formed in the sidewall 610 by defining a receiving hole 620 in the sidewall 610 and including an inner flange 623 formed around the receiving hole 620. The inner flange 623 is thinner than the sidewall 610 therefore it can be seen the inner flange 623 is stepped from the sidewall 610 thereby defining a recess 622 communicating with the receiving hole 620. The shape of the receiving hole 620 is an oval shape and the recess 622 is also ovally shaped. A positioning post 630 is formed on the inner surface 614 of the sidewall 610 and positioned next to the receiving hole 620.

Figure 3:
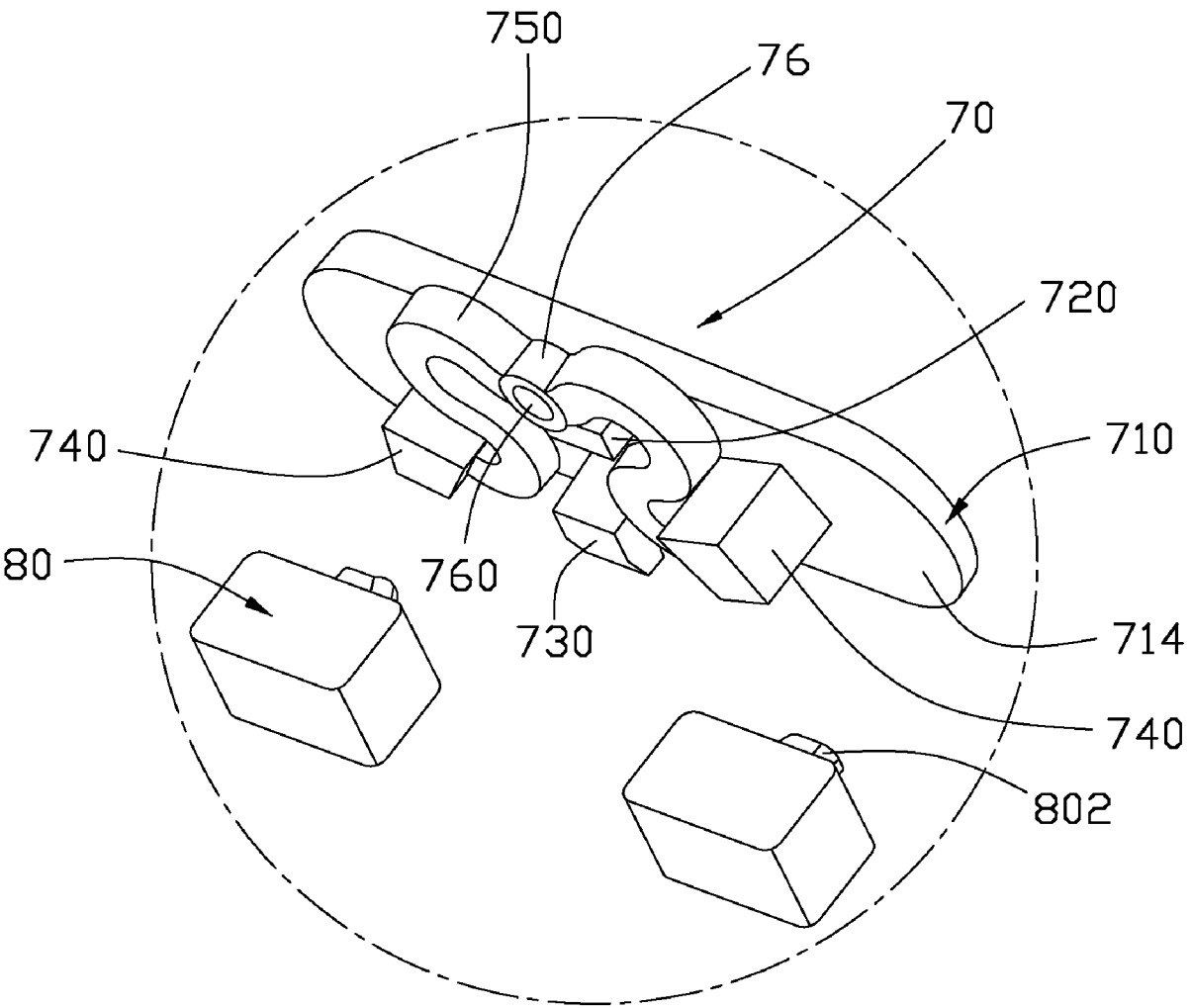
FIG. 3 is an enlarged view of a circled portion III of FIG. 2.

The side key assembly includes a button 70 and two switches 80. Referring to FIG. 3, the button 70 includes an operating portion 710, a locking block 720, a hook 730, two touching blocks 740 and two elastic arms 750 integrally formed together. The button 70 may, advantageously, be made from a durable, resilient polymer, e.g., a plastic such as acrylonitrile-butadiene-styrene (ABS), polyurethane, or acryl.

Figure 4:
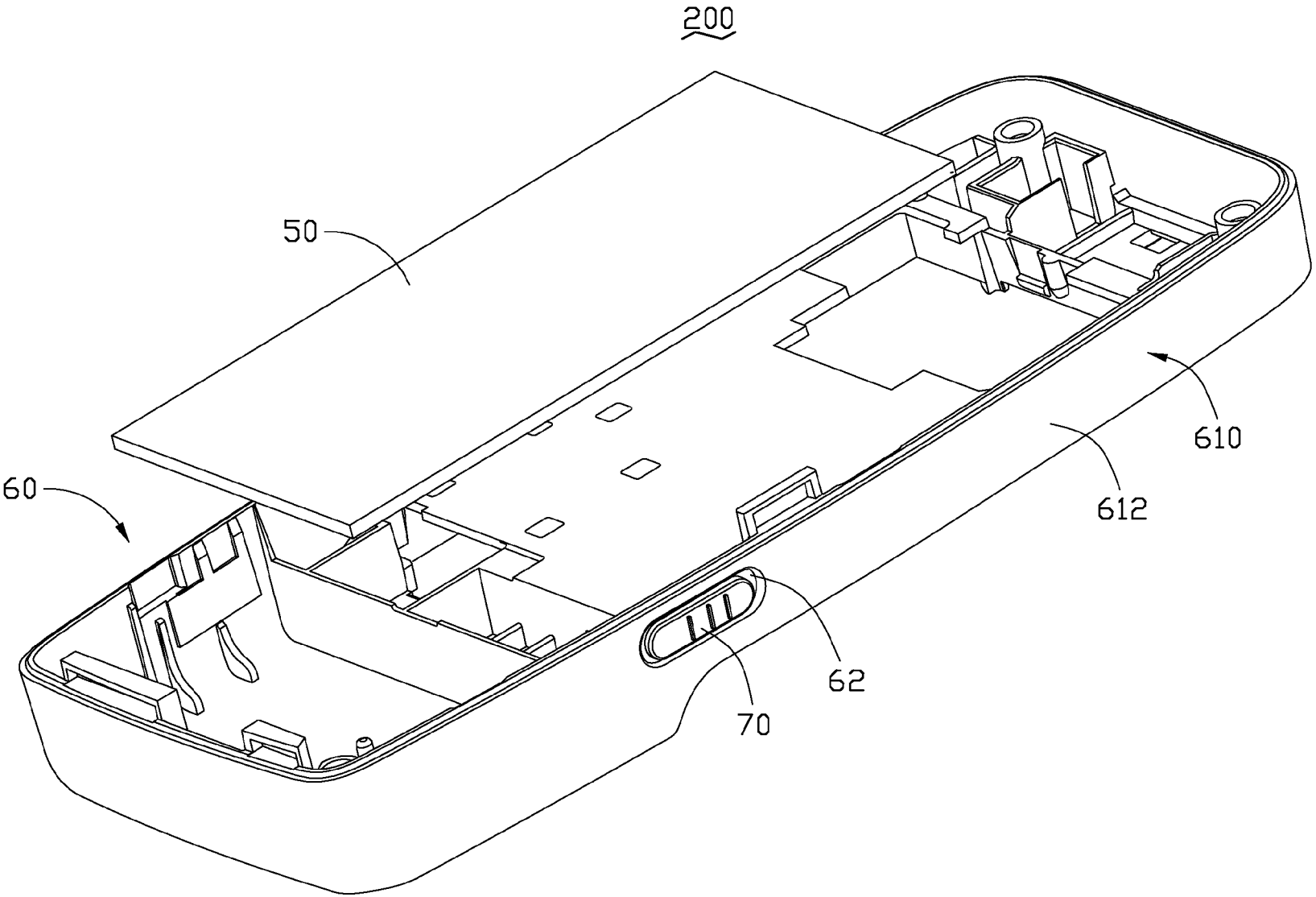
FIG. 4 is an isometric, assembled view of the housing and the side key assembly shown in FIG. 1.

The shape of the operating portion 71 0 is configured for being slidingly received in the recess 622 of the housing 60. The size of the operating portion 710 is larger than the receiving hole 620 of the housing 60, so that the operating portion 710 cannot be inserted in the receiving hole 620. The operating portion 710 has an upper surface 712 (particularly see FIG. 1) and a lower surface 714. A plurality of ribs 716 are formed with each rib separated from its neighboring ribs by a space on the upper surface 712, thus facilitating pushing/gripping by a user. In assembly configuration, the operation portion 710 of the button 70 is received in the recess 622 while other portions of the button 70 are partially received in the receiving hole 620 and partially extending through the receiving hole 620. The thickness of the operating portion 710 is so sized to be less than a depth of the recess 622 that the operating portion 710 is positioned in the recess 622 and under the upper surface 612 of the sidewall 610. In other words, the whole operating portion 710 particularly including the ribs 716 is structured and arranged to be lower than the upper surface 612 of the sidewall 610 as shown in FIG. 4.

The locking block 720 and the hook 730 are formed on the central area of the lower surface 714 and respectively positioned at two opposite sides (i.e., upper side and lower side) of the lower surface 714. The two touching blocks 740 are symmetrically positioned near two ends of the operating portion 710.

The two elastic arms 750 each respectively extend from a corresponding one of the touching blocks 740 and extend out beyond an upper side of the operating portion 710. The elastic arms 750 are spaced from the lower surface 714 of the operating portion 710 therefore the elastic arms 750 may be moved with respect to the lower surface 714 of the operating portion 710. The two elastic arms 750 are symmetrically positioned, and connected with each other at a common end portion 76. The elastic arms 750 are generally a bent, angled, or otherwise curved configuration. Such a configuration allows the elastic arms 750 to exhibit a spring bias (i.e., to act as a spring), thus having a tendency to return to an initial shape/position when the elastic arms 750 are released from an external force which is temporarily applied on it. In this embodiment, each elastic arm 750 is substantially S-shaped. A positioning hole 760 is defined in the common end portion 76 of the two elastic arms 750. The positioning hole 760 is configured for receiving the positioning post 630 of the housing 60.

The switches 80 are fixed on the printed circuit board 50. Each switch 80 has a contact portion 802. When an external force is applied on the contact portion 802, the corresponding switch 80 is turned on and generate an electronic signal.

Figure 5:
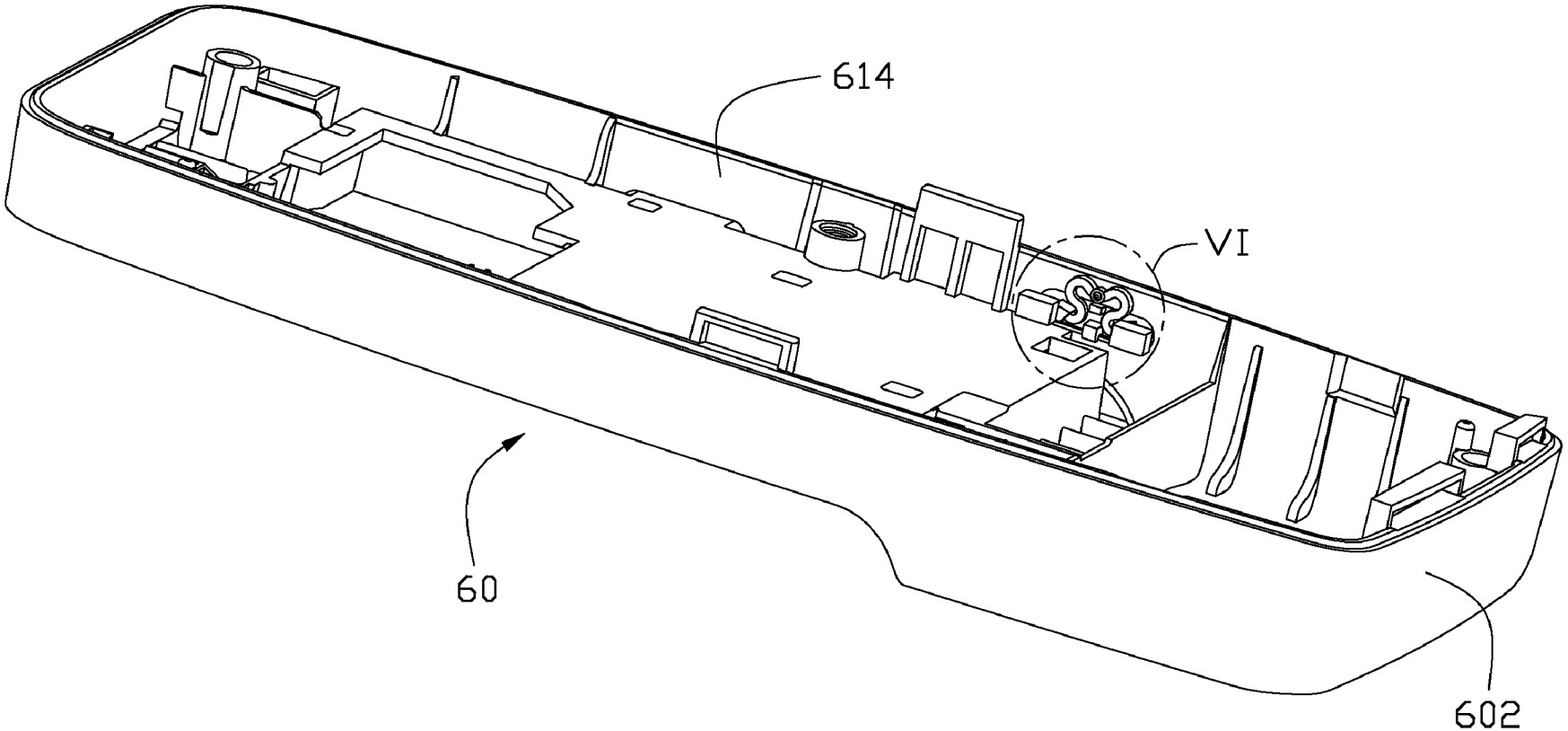
FIG. 5 is similar to FIG. 4, but showing another aspect.
Figure 6:
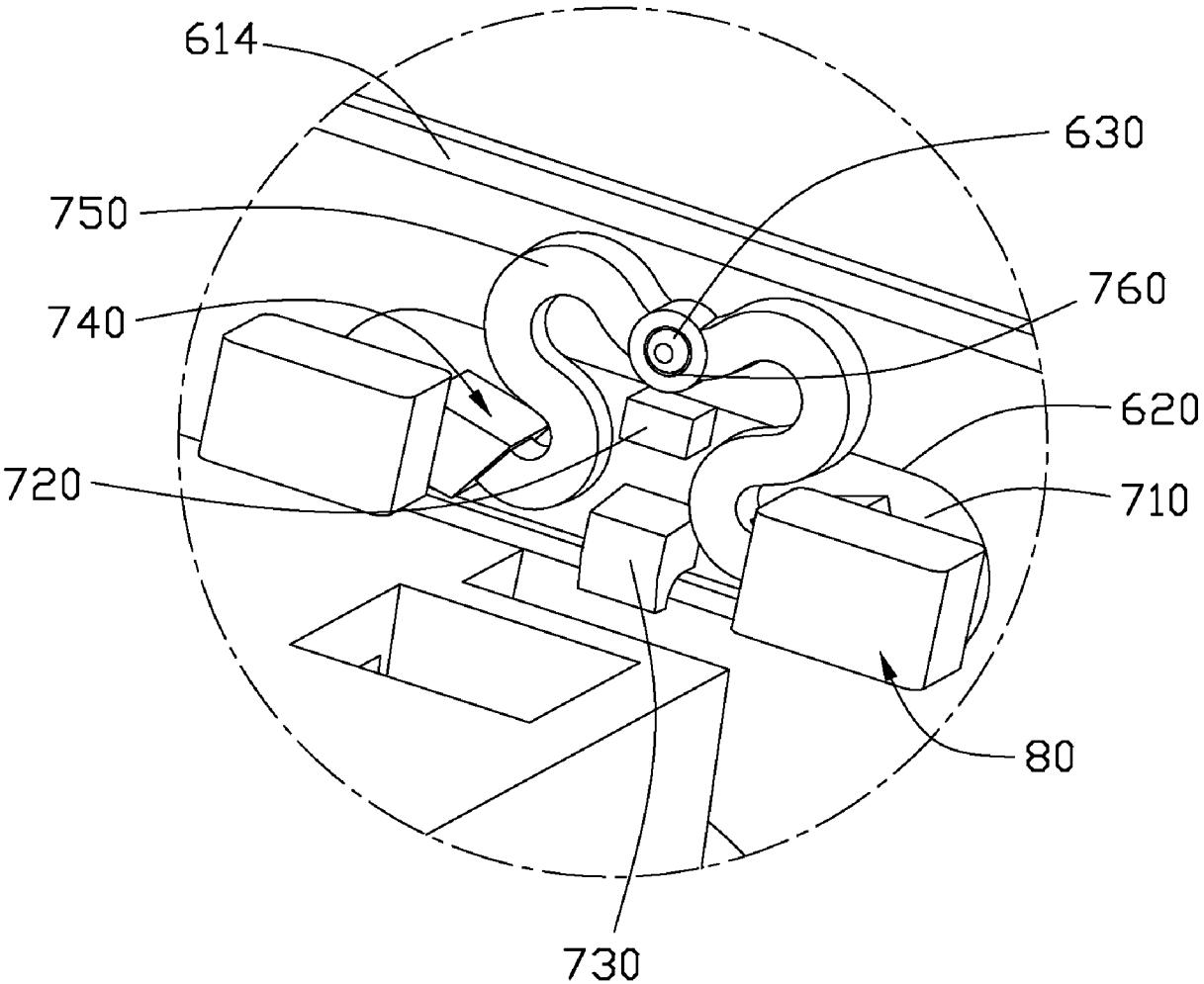
FIG. 6 is an enlarged view of a circled portion VI of FIG. 5.
Figure 7:
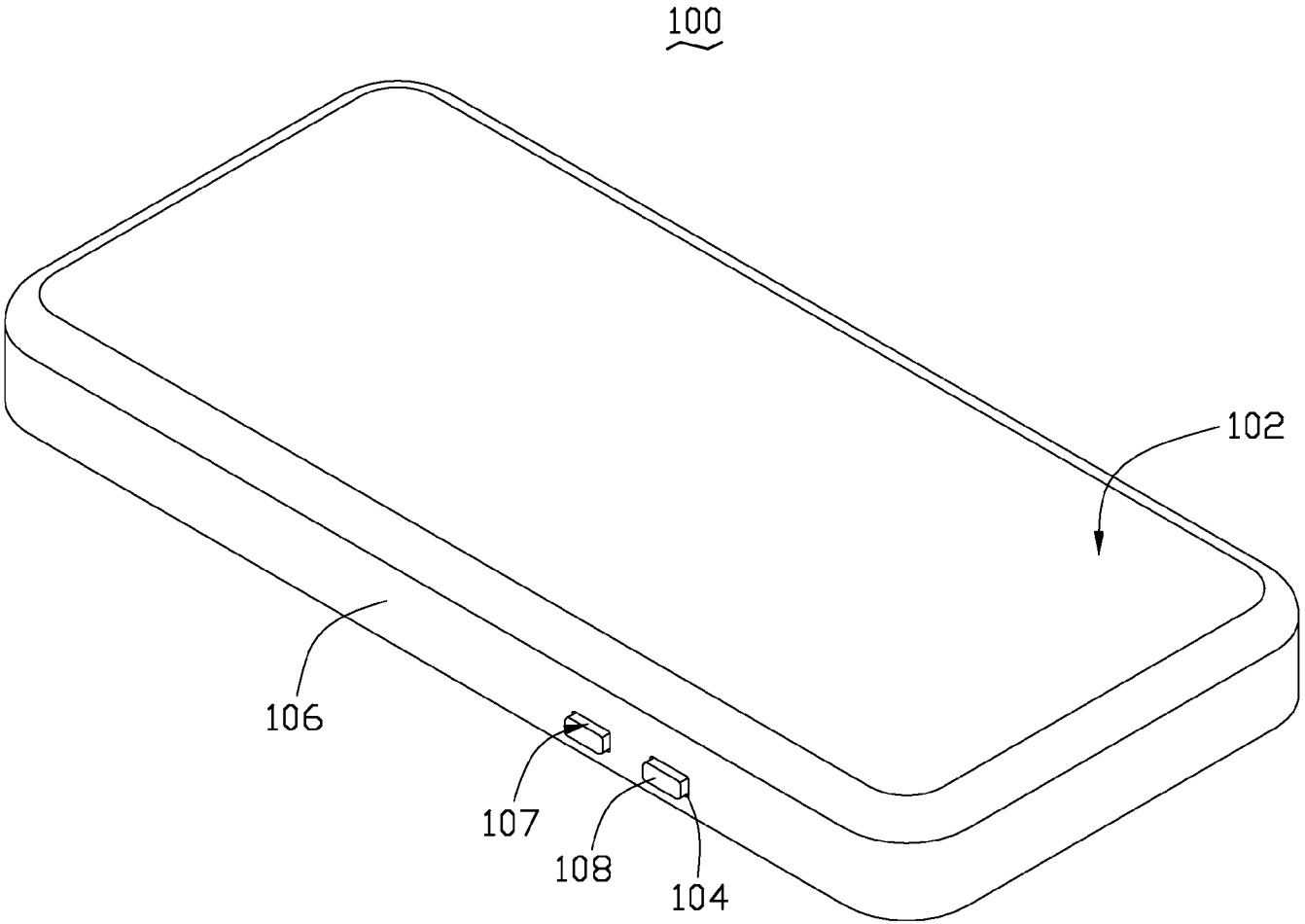
FIG. 7 (RELATED ART)
FIG. 7 is an isometric, assembled view of a conventional side key assembly mounted on a portable electronic device.

Referring to FIGS. 4-6, in assembling the button 70 to the housing 60, firstly, the button 70 is placed in the recess 622 of the housing 60. The operating portion 710 is being shown outside. The positioning hole 760 and the positioning post 630 are on the same side with respect to the sidewall 610. The elastic arms 750 and the hook 730 are then pushed from one side of the sidewall 610 in order to deform and respectively drawn through the receiving hole 620 to another side of the sidewall 610. When the pressure such as pushing and drawing force applied on the elastic arms 750 and the hook 730 is released, the elastic arms 750 and the hook 730 return to their original shape and the hook 730 firmly clasps a lower side of the inner flange 623 of the sidewall 610. The locking block 720 and the touching blocks 740 extend through the receiving hole 620 of the sidewall 610 and the locking block 720 resists an upper side of the inner flange 623 of the sidewall 610. Finally, the positioning post 630 of the sidewall 610 is inserted into the positioning hole 760 of the button 70. The touching blocks 740 are each respectively positioned adjacent to the contact portion 802 of the corresponding switch 80. It should be understood that after assembling, the hook 730 and the locking block 720 respectively abut against opposite sides of the inner flange 623, and the positioning post 630 is engaged in the positioning hole 760, so that the button 70 is mounted in the housing 60.

In use, the user pushes the button 70 to slide along the inner flange 623 of the sidewall 610. One of the two touching blocks 740 move towards a corresponding switch 80. At the same time, the elastic arm 750 connected with the touching block 740 is deformed. When the touching block 740 touches the contact portion 802 of the switch 80, the switch 80 is turned on so as to generate an electronic signal. When pressure applied on the button 70 is released, the elastic arms 750 returns to its original configuration. Therefore, the button 70 returns to its original location due to the recovery rebound of the elastic arm 750.

It should be understood that since the hook 730 clasps one side of the inner flange 623 and the operating portion 710 abuts against an opposite side of the inner flange 623, the button 70 cannot move in a vertical direction even if it is applied with an external force in the vertical direction. In addition, the operating portion 710 is lower than the upper surface 612 of the sidewall 610, which makes it not easily be pushed or touched by an accidental action. Therefore, accidental mistakes of operating the button 70 could be avoided.

In an alterative embodiment according to the present invention, the number of elastic arms 750 might be just one. The elastic arm 750 may have two ends, wherein one end thereof joints with one side of the operating portion 710 and the other end thereof is fixed on the sidewall 610.

It should be understood that the positioning post 630 of the sidewall 610 and the positioning hole 760 of the button 70 might be omitted, and the ends of the two elastic arms 750 might be melted or soldered on the sidewall 610.

It also should be understood that the hook 730 might be positioned at one end of the operating portion 710, and the locking block 720 might be positioned at another end of the operating portion 710.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A side key assembly being mounted on a housing having a sidewall, the side key assembly comprising:

a socket which is formed in the sidewall, the socket including an inner flange;

a button including an operating portion, two touching blocks, at least one elastic arm, a hook and a locking block; the operating portion being slidingly received in the socket, one end of the at least one elastic arm connecting with the operating portion while the other end being fixed to the sidewall of the housing, the hook and the locking block extending from the lower surface of the button for abutting against opposite sides of the inner flange; and two switches, each switch including a contact portion which is positioned adjacent to a corresponding touching block which extends from the button, each switch being turned on when the corresponding touching block is moved by the button thereby touching the contact portion thereof.

2. The side key assembly as claimed in claim 1, wherein the inner flange is stepped from a portion of the sidewall and defines a receiving hole in the center thereof, a recess being defined in the socket and in communication with the receiving hole, wherein the operating portion of the button is received in the recess.

3. The side key assembly as claimed in claim 2, wherein a thickness of the operating portion is sized to be less than a depth of the recess.

4. The side key assembly as claimed in claim 2, wherein the operating portion includes an upper surface and a lower surface from which the touching blocks extend.

5. The side key assembly as claimed in claim 4, wherein a plurality of ribs are formed on the upper surface of the operating portion.

6. The side key assembly as claimed in claim 1, wherein the number of the elastic arms is two, the two elastic arms each respectively extend from a corresponding one of the touching blocks.

7. The side key assembly as claimed in claim 6, wherein a positioning post is positioned next to the receiving hole, a positioning hole is defined in the common end portion of the two elastic arms, and the positioning hole is configured for receiving the positioning post.

8. The side key assembly as claimed in claim 7, wherein each elastic arm is S-shaped, the two elastic arms are symmetrically positioned, and the elastic arms are configured to be spaced from the lower surface of the operating portion.

9. A portable electronic device, comprising:

a housing including a sidewall which defines a socket therein;

a printed circuit board mounted in the housing, two switches being positioned on the printed circuit board, each switch including a contact portion; and a button being movably connected with the sidewall, the button including an operating portion, two touching blocks and two elastic arms, the operating portion being slidingly received in the socket, the two touching blocks being respectively positioned adjacent to a corresponding contact portion of the switch, the two elastic arms respectively extending from a corresponding touching block and connecting with each other at a common end thereof, the elastic arms and the touching blocks being integrally formed with the operating portion, the common end of the elastic arms being firmly fixed on the housing.

10. The portable electronic device as claimed in claim 9, wherein each elastic arm is S-shaped, the two elastic arms are symmetrically positioned, and a space is formed between the elastic arms and the lower surface of the operating portion.

11. The portable electronic device as claimed in claim 10, wherein a positioning post is positioned adjacent to the socket, a positioning hole is defined in the common end of the two elastic arms, and the positioning hole is configured for receiving the positioning post.

12. The portable electronic device as claimed in claim 9, wherein the socket comprises an inner flange which is stepped from a portion of the sidewall and defines a receiving hole in the center thereof, a recess being defined in the socket and in communication with the receiving hole, wherein the operating portion of the button is received in the recess.

13. The portable electronic device as claimed in claim 12, wherein a thickness of the operating portion is sized to be less than a depth of the recess.

14. The portable electronic device as claimed in claim 12, wherein the button further comprises a hook and a locking block extending from a lower surface of the button for abutting against opposite sides of the inner flange.

15. The portable electronic device as claimed in claim 9, wherein the operating portion includes an upper surface and a lower surface from which the touching blocks extend.

16. The portable electronic device as claimed in claim 15, wherein a plurality of ribs are formed on the upper surface of the operating portion.

17. A side key assembly being mounted on a housing having a sidewall, the side key assembly comprising:

a socket formed in the sidewall;

a post formed on the sidewall and positioned adjacent to the socket;

a button including an operating portion, two touching blocks and a curved strip, two ends of the curved strip being fixed at two opposite ends of the operating portion, the curved strip defining a positioning hole at a middle portion thereof, the operating portion being slidingly received in the socket, the curved strip being fixed to the sidewall by engagement between the post and the positioning hole; and two switches, each switch including a contact portion which is positioned adjacent to a corresponding touching block, each switch being turned on when the corresponding touching block is moved by the button thereby touching the contact portion thereof.

18. The side key assembly as claimed in claim 17, wherein the socket comprises an inner flange, the button further comprises a hook and a locking block, and the hook and the locking block extend from the lower surface of the button for abutting against opposite sides of the inner flange.

* * * * *